US007399242B1

(12) United States Patent
Smith

(10) Patent No.: US 7,399,242 B1
(45) Date of Patent: Jul. 15, 2008

(54) WEIGHTED TRAINING BAT

(76) Inventor: Douglas R. Smith, 5024 Sturbridge Ct., Sarasota, FL (US) 34238

( * ) Notice: Subject to any disclaimer, the term of this patent is extended or adjusted under 35 U.S.C. 154(b) by 0 days.

(21) Appl. No.: 11/476,531

(22) Filed: Jun. 28, 2006

(51) Int. Cl.
*A63B 69/00* (2006.01)

(52) U.S. Cl. ..... 473/457; 473/564

(58) Field of Classification Search ..... 473/422, 473/437, 457, 519, 558–568, 231
See application file for complete search history.

(56) References Cited

U.S. PATENT DOCUMENTS

| | | | | |
|---|---|---|---|---|
| 514,420 | A | 2/1894 | Jacobus | |
| 1,121,189 | A * | 12/1914 | Lincoln | 473/564 |
| 1,499,128 | A | 6/1924 | Shroyer, Jr. | |
| 1,665,195 | A * | 4/1928 | Cohn | 473/520 |
| 3,116,926 | A | 1/1964 | Owen | |
| 4,682,773 | A * | 7/1987 | Pomilia | 473/457 |
| 4,763,899 | A * | 8/1988 | Hundley | 473/256 |
| 5,277,421 | A * | 1/1994 | Rewolinski | 473/457 |
| 6,254,502 | B1 | 7/2001 | Becker | |
| 6,280,353 | B1 | 8/2001 | Brundage | |
| 6,561,930 | B2 | 5/2003 | Mabry | |
| 6,767,299 | B1 | 7/2004 | Chang | |
| 6,918,843 | B1 | 7/2005 | Franssen | |
| 2005/0096161 | A1 | 5/2005 | Gallagher | |

* cited by examiner

*Primary Examiner*—Mitra Aryanpour
(74) *Attorney, Agent, or Firm*—Charles J. Prescott

(57) ABSTRACT

A weighted training bat formed of wood and having a handle and a barrel. The barrel has an elongated hollow cavity formed into a distal end thereof and an outer cavity portion having internal threads. Lead which has been poured or cast-in-place into and filling the proximal portion of the cavity, when solidified, adheres to the interior surface of the cavity to resist loosening, the lead adding weight at and evenly astride the sweet spot of the bat. An elongated wooden screw having external threads is tightly engaged into internal threads in the cavity so the screw bears against the lead to further prevent loosening of the lead. The threads are permanently glued and an outer end of the screw is formed to blend with the contour of the end of the barrel.

3 Claims, 1 Drawing Sheet

WEIGHTED TRAINING BAT

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to the field of training baseball bats, and more particularly to such a training bat which utilizes a cast-in-place lead within a cavity which spans the sweet spot of the bat and which is permanently held in place by multiple retaining means to insure that the lead does not become dislodged or loose within the bat.

2. Description of Related Art

The use of training bats which are weighted to enhance the muscle, speed and coordination skills of the batter are well known. One such well-known technique is the temporary addition of a weighted ring or donut slid over the handle of the bat and which is sized to be retained from slipping off the barrel of the bat while the batter takes practice swings before coming to the plate for either batting practice or during a game.

Other prior art devices which have been patented are also well known. U.S. Pat. No. 514,420 to Jacobus discloses a bat with an axial perforation longitudinally formed in the body wherein one or more heavy weights are inserted, the outer end of the cylindrical perforation is securely closed with a threaded cylindrical plug. A similar metal bat is disclosed by Shroyer, Jr. in U.S. Pat. No. 1,499,128.

Owen, et al. teaches a weighted baseball bat in U.S. Pat. No. 3,116,926 and a warm-up bat with an integrally molded weight is taught by Hundley in U.S. Pat. No. 4,763,899. Another weighted practice bat is taught by Rewolinski in U.S. Pat. No. 5,277,421 and a weighting system for sports balls and hitting implements is taught by Becker in U.S. Pat. No. 6,254,502.

U.S. Pat. No. 6,280,353 to Brundage teaches a training bat with weights formed in a hollow cavity in the barrel portion and an interesting training ball bat is taught by Mabry in U.S. Pat. No. 6,561,930. Chang discloses a wood baseball bat with movable weights along an axial direction of the core in U.S. Pat. No. 6,767,299.

A baseball-training bat with interchangeable threaded weight plugs is taught in U.S. Pat. No. 6,918,843 to Franssen. A newly published pending patent application for a training bat and method is disclosed in U.S. Pub. US2005/0096161 in Gallagher.

The present invention provides a weighted training bat which adds a cast-in-place lead weight into a cylindrical hole bored into a conventional wooden bat and which is secured in place by multiple retaining means including an elongated threaded wooden screw permanently glued in place to insure that the lead does not become dislodged or loose within the bat during batting practice.

BRIEF SUMMARY OF THE INVENTION

This invention is directed to a weighted training bat formed as a unit of wood and having a handle and a barrel. The barrel has an elongated hollow cavity formed into a distal end of the barrel, an outer or distal portion of the cavity having internal threads formed into the side wall surface thereof. Lead which has been poured into and filling the proximal portion of the cavity, when solidified, adheres to the interior surface of the cavity to resist loosening the lead during use of the bat, the lead adding weight to the sweet spot of the bat. An elongated wooden screw having external threads matably engages with internal threads in the cavity so that a proximal end of the screw is in contact against one end of the lead to further prevent loosening of the lead. The threads are glued to permanently secure the screw in the outer portion of the cavity and an outer end of the screw is formed to mate and blend with the contour of the distal end of the barrel portion.

It is therefore an object of this invention to provide a baseball training bat which is weighted at approximately the sweet spot to enhance strength, speed and coordination of the batter during practice.

Yet another object of this invention is to provide a weighted training bat utilizing cast-in-place poured lead formed into a longitudinal cavity formed into the distal end of the barrel of the bat, the remainder of the cavity tightly filled with a screwed-in-place threaded wooden screw tightened against the lead and form finished to match the distal contour of the bat.

Still another object of this invention is to provide a weighted training bat incorporating a cast-in-place quantity of lead which is secured from loosening or movement within the cavity formed into the bat by multiple retention means provided.

In accordance with these and other objects which will become apparent hereinafter, the instant invention will now be described with reference to the accompanying drawings.

BRIEF DESCRIPTION OF THE SEVERAL VIEWS OF THE DRAWING(S)

DETAILED DESCRIPTION OF THE INVENTION

Figure 1:
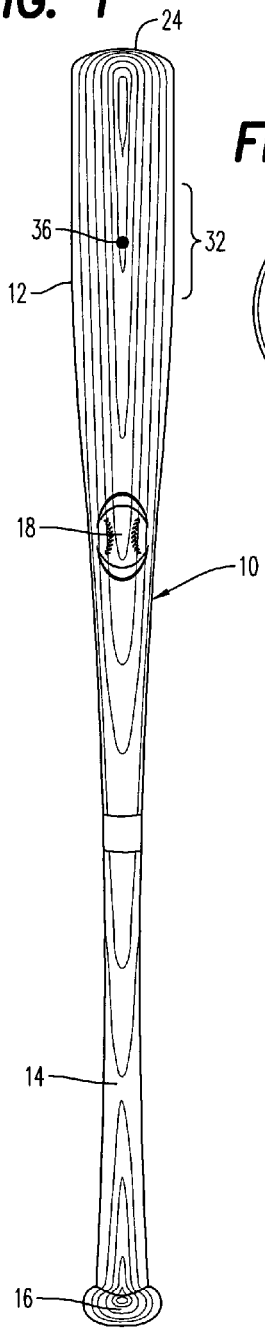
FIG. 1 is a side elevation view of the training bat of the present invention.
Figure 3:
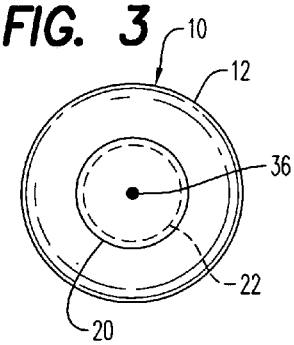
FIG. 3 is a top end view of FIG. 2.

Referring now to the drawings, the present invention is there shown generally at numeral 10 formed as a conventional wooden baseball bat in all dimensional aspects and having a barrel portion 12, a handle portion 14, a knob 16 and typically a crest or brand 18. Again, the training bat 10 is formed as a unit of well-known hardwood of conventional or regulation size features.

All baseball bats possess a "sweet spot" shown at 36 and which is the point along the length of the bat 10 in the barrel portion 12 which, when striking a baseball, will cause the bat 10 to rebound in such a fashion that the rebound force is completely balanced by the turning force of the bat 10. The closer to the end of the bat the ball is struck, the more the grip 14 will rotate forwardly out of the hands of the batter whereas if the ball is struck closer to the handle 14, the bat's tip will try to rotate forwardly. There is a small sweet spot 36 in the region of 32 where these tendencies cancel one another.

As a generality, these sweet spots 36, although differing somewhat in location along the barrel 12, fall within a region 32 located approximately 5" to 7" from the end 24 of the barrel 12 where the batted-ball speed is the highest and the sensation to the hands is minimized. It is an object of this invention to enhance the training bat function by placing additional weight into the barrel 12 of the bat 10 along and either side of the sweet spot 36 to maintain the existing sweet spot location of the bat 10. To accomplish the weighting feature of this invention, a longitudinal bore is formed longitudinally of the barrel 12 starting from the distal end 24 to define a cavity 28. This cavity 28 is typically formed by drilling or machining after which internal threads 22 are formed to the distal end 24.

Figure 2:
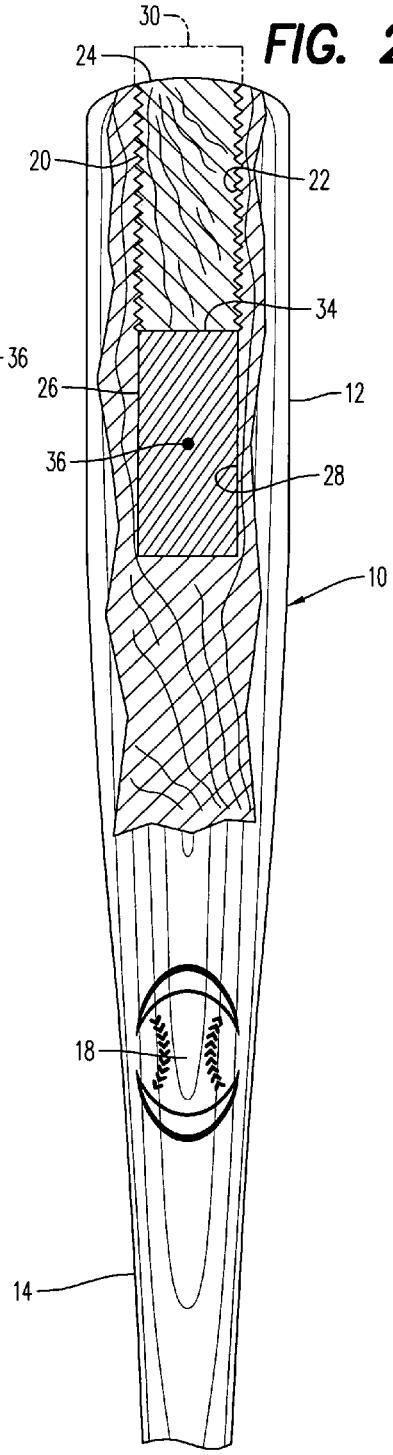
FIG. 2 is an enlarged broken view of the barrel portion of FIG. 1.

The lead weight 26 is preferably cast in place wherein, with the bat 10 in the upright orientation shown in FIG. 2, molten or liquid lead is poured into the cavity 28 in a preselected amount, typically 5 to 7 ounces over a length of approximately 3" to 4", the cavity diameter 28, being approximately 1". The pourable lead is then allowed to cool and harden, after which a hammering or tapping process is utilized against the exposed end 34 of the lead 26 so as to further insure that the lead 26 has been forced into the interior texture and shape of the cavity 28 to the fullest extent possible. This second means for lead retention is important so as to help insure that the lead 26 does not become loosened within the cavity 28 during batting practice.

Once the lead 26 has been fully and compliantly poured, hardened and hammer-forced into the texturing contour of the cavity 28, a wooden screw 20, having external threads which matably engage into the internal threads 22, is threadably engaged into this portion of the cavity 28. The wooden screw 20 is longer than the anticipated length of the internal threads 22 so that an exposed portion 30 remains exposed for tightening of the screw 20 against the end 34 of the lead 26. Once the threaded screw 20 is tightened sufficiently, the remainder 30 is machined off so as to matably comply with the existing distal end surface 24 of the barrel 12.

To further insure that the lead weight 26 remains absolutely stationary within the cavity 28, the wooden screw 20 is coated with a suitable glue before being threadably engaged into the internal threads 22. After the tightening of the wooden screw 20 has been accomplished, the set glue will render the wooden screw 20 to be an integral permanent part of the barrel 12 and bat 10.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

The invention claimed is:

1. A weighted training bat consisting of:

an elongated baseball bat formed as a unit of wood and having a handle portion and a barrel portion;

said barrel portion having an elongated hollow cavity formed into a distal end of, and extending longitudinally and concentrically with, a portion of said barrel portion;

said cavity having internal threads formed into the side wall surface thereof extending from said distal end;

a quantity of lead poured into and filling a bottom portion of said cavity to increase the weight of a central sweet spot of said bat, said poured lead, when solidified, adhering to an interior surface of said cavity to resist loosening of said lead during use of said bat;

an elongated wooden screw having external threads which matably engage with said internal threads in said cavity, said screw being threaded into said cavity wherein a proximal end of said screw is in contact with one end of said lead, said threads being glued together to permanently secure said screw in said cavity;

an outer end of said screw being formed to mate and blend with the contour of the distal end of said barrel portion.

2. A weighted training bat consisting of:

an elongated baseball bat formed as a unit of wood and having a handle portion and a barrel portion;

said barrel portion having an elongated hollow cavity formed into a distal end of, and extending longitudinally and concentrically with, said barrel portion through a sweet spot of said bat;

said cavity having internal threads formed into a portion of the side wall surface of said cavity;

a quantity of lead poured into and filling a bottom portion of said cavity to weight of a sweet spot of said bat; said poured lead, when solidified, adhering to an interior surface of said cavity to resist loosening of said lead during use of said bat;

an elongated wooden screw having external threads which matably engage with said internal threads in said cavity, a proximal end of said screw being in contact against one end of said lead, said threads being glued together to permanently secure said screw in said cavity;

an outer end of said screw being formed to mate and blend with the contour of said distal end of said barrel portion.

3. A weighted training bat consisting of:

an elongated baseball bat formed as a unit of wood and having a handle portion and a barrel portion;

said barrel portion having an elongated cylindrical cavity formed longitudinally into a distal end of, and extending longitudinally and concentrically with, a portion of said barrel portion;

said cavity having internal threads formed into the side wall surface thereof extending from said distal end;

said cavity being partially filled at a bottom portion thereof by a quantity of cast-in-place lead poured into said cavity to increase the weight of a central sweet spot of said bat without substantially altering the location of the sweet spot;

said poured lead, when solidified, adhering to an interior surface of said cavity to resist loosening of said lead during use of said bat, said lead also being hammered at an exposed end thereof into said cavity to further force said lead into the texture and shape of said cavity;

a remaining distal portion of said cavity being filled with an elongated wooden screw having external threads which matably engage with said internal threads in said cavity, said screw being tightly threaded into said cavity against the hammered end of said lead to further resist loosening of said lead by fully and tightly filling said cavity with said lead and said screw, said threads being glued together to permanently secure said screw in said cavity;

an outer end of said screw being formed to mate and blend with the contour of the distal end of said barrel portion.

* * * * *

UNITED STATES PATENT AND TRADEMARK OFFICE

CERTIFICATE OF CORRECTION

PATENT NO. : 7,399,242 B1
APPLICATION NO. : 11/476531
DATED : July 15, 2008
INVENTOR(S) : Douglas R. Smith It is certified that error appears in the above-identified patent and that said Letters Patent is hereby corrected as shown below:

Column 4, line 22 delete the first occurrence of the word "of" and delete the ";" and insert a --,-- therefor.

Signed and Sealed this

Twenty-third Day of September, 2008

JON W. DUDAS
*Director of the United States Patent and Trademark Office*